United States Patent [19]

Bona

[11] 4,143,772

[45] Mar. 13, 1979

[54] METHOD OF, AND DEVICE FOR, RAPIDLY THREADING PERFORATED ARTICLES ONTO A ROD, IN PARTICULAR A ROD OF A DISPLAY UNIT

[75] Inventor: Edmond Bona, Beton Bazoches, France

[73] Assignee: Droguet International, Paris, France

[21] Appl. No.: 854,373

[22] Filed: Nov. 23, 1977

[30] Foreign Application Priority Data

Nov. 26, 1976 [FR] France ..... 76 35686

[51] Int. Cl.[2] ..... A47F 7/00

[52] U.S. Cl. ..... 211/59.1; 206/493

[58] Field of Search ..... 211/54.1, 57.1, 59.1, 211/49; 206/493, 801, 809; 63/2; 224/7 R, 7 A, 7 D, 7 E, 27, 46 R; 53/3; 223/48; 29/241, 433

[56] References Cited

U.S. PATENT DOCUMENTS

| | | | |
|---|---|---|---|
| 1,478,112 | 12/1923 | Flather | 206/493 X |
| 2,943,743 | 7/1960 | Thorson | 211/59.1 |
| 3,143,265 | 8/1964 | Ruderian | 224/7 E X |
| 3,211,293 | 10/1965 | Tarnoff | 211/59.1 |
| 3,827,571 | 8/1974 | Koutny | 211/59.1 |

FOREIGN PATENT DOCUMENTS

| | | | |
|---|---|---|---|
| 390113 | 3/1933 | United Kingdom | 206/493 |

*Primary Examiner*—Roy D. Frazier
*Assistant Examiner*—Terrell P. Lewis
*Attorney, Agent, or Firm*—Cooper, Dunham, Clark, Griffin & Moran

[57] ABSTRACT

A method of, and a device for, facilitating the threading in rapid succession of a series of perforated articles, for example small bags, boxes and other packages, onto a rod, especially a rod fixed at one end in a display unit for the articles. The device includes an elongate support, which may be a flexible cord, having a tubular coupling at one end which is engageable over the free end of the rod, the tubular coupling being dimensioned externally so that it passes through the perforations in the articles. A stop member may be provided at the other end of the elongate support and, when the latter is in the form of a flexible cord, the stop member may be removably engageable in the tubular coupling so that the device can be formed into a closed ring which can serve as a handle for carrying articles threaded onto the elongate support.

4 Claims, 3 Drawing Figures

Figures 1, 2, 3:
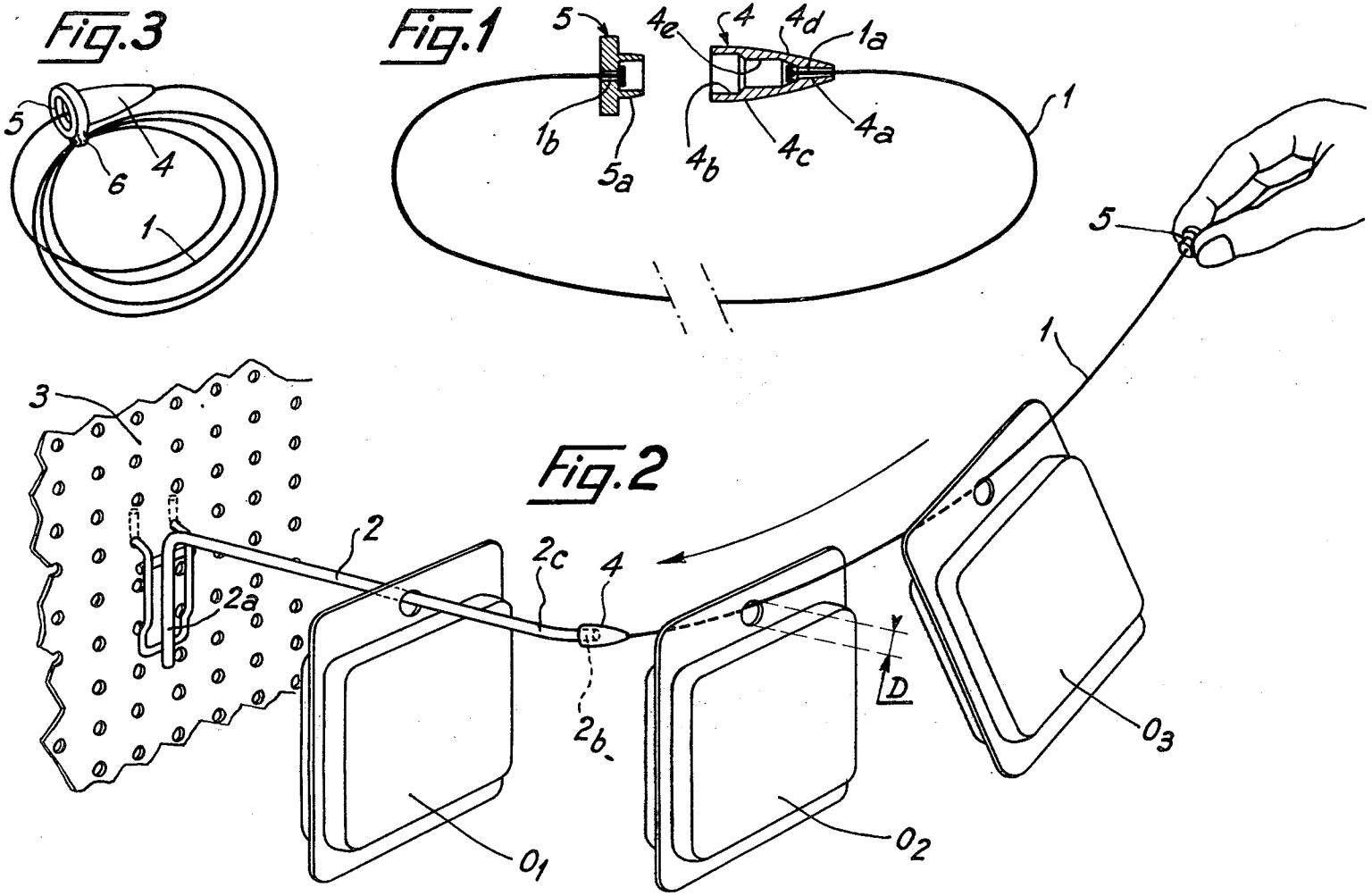

1
1a
4a
4d
4c
4
4b
4e
5
5a
1b 5
1
O3
D
O2
4
2b
2c
O1
2
2a
3

4
1
6
5

METHOD OF, AND DEVICE FOR, RAPIDLY THREADING PERFORATED ARTICLES ONTO A ROD, IN PARTICULAR A ROD OF A DISPLAY UNIT

This invention relates to a method of, and a device for, rapidly threading perforated articles onto a rod, in particular a rod of a display unit.

Although the operation of threading a series of perforated articles, for example small bags, boxes or other packages, onto a rod, and in particular onto a rod of a display unit, may appear to be a simple operation, not recessitating the employment of any particular aptitude, it is not the same for the very numerous operations of this kind which must be effected for example for stocking the very many rods of several large display units, such as are found especially in large stores. It will be appreciated that the threading of several hundreads or even several thousands of perforated articles onto the rods of display units requires several hours of fastidious and relatively detailed work, in order to ensure for example, that some of the bags or boxes are not damaged, for example pierced, by the ends of the rods on which they have to be threaded.

The present invention enables these threading operations to be performed with a rapidity and convenience which permits considerable reduction of the labour and the time necessary for stocking large display units, in particular in large stores.

According to one aspect of the invention, a method of threading perforated articles onto a rod fixed at a first end, for example in a display unit, comprises the steps of threading the perforated articles onto an elongate support, then connecting one of the ends of the elongate support to the second, free end of the said rod by means of an appropriately dimensioned coupling, then causing the row of articles threaded on the support to slide in the direction of the free end of the rod so that the articles are transferred onto the rod by passing over the coupling.

According to a further aspect of the invention a device for threading perforated articles onto a rod fixed at a first end, comprises an elongate support and a tubular coupling fixed to a first end of said support, said tubular coupling being dimensioned internally to receive the second, free end of the rod and being dimensioned externally so that it can pass through the perforations in said articles.

The invention will now be described, by way of example, with reference to the accompanying drawing, in which:

FIG. 1 is a sectional view of one embodiment of a device for carrying out the method according to the invention, FIG. 2 is a perspective view illustrating the employment of the device of FIG. 1 for threading a row of perforated articles in rapid succession onto a rod of a display unit, and FIG. 3 is a perspective view of another embodiment of the device according to the invention in stored condition.

The device according tp the invention which is illustrated schematically in FIG. 1, is intended for threading in rapid succession a series of perforated articles $O_1$, $O_2$, $O_3$ . . ., for example small sealed bags of the type known as "blisters", onto a metallic rod 2, one end 2*a* of which is fixed in known manner to, for example, a perforated panel 3 of a large display unit, to which a large number of rods like the rod 2 can be fastened at appropriate distances from one another.

The device shown in FIG. 1 is constituted essentially by a flexible cord 1, for example of plastics material, of appropriate length. If the entire length of the rod 2 of the display unit is to be filled with perforated articles such as $O_1$, $O_2$, $O_3$, (the maximum number of which that can be accommodated on the rod therefore depending on the dimensions of these articles in the direction of the rod 2), the flexible cord 1 must have a length at least slightly greater than that of the rod 2. To the first end 1*a* of the cord 1 there is fixed a tubular coupling 4 which, in the embodiment shown in FIG. 1, is a moulded plastics member. The coupling 4 has a first axial bore 4*a* of small diameter in which the first end 1*a* of the cord 1 is engaged and held by an end of increased thickness, obtained for example by forming a knot at the end 1*a*. At its opposite end, the tubular coupling 4 has an axial bore 4*b* of diameter appreciably greater than that of the bore 4*a* and at least equal to that of the free end 2*b* of the rod 2 of the display unit (see FIG. 2). Externally, the tubular coupling 4 has a substantially cylindrical surface 4*c* around the bore 4*b*, the diameter of the surface 4*c* being smaller than the diameter D of the perforations of the articles $O_1$, $O_2$, $O_3$. Around the bore 4*a*, the tubular coupling 4 has, in the embodiment illustrated, an external surface 4*d* of elongate ovoidal of frustoconical shape. The second end 1*b* of the flexible cord 1 is engaged and held by a thickened portion, for example a knot formed at its end 1*b*, in an axial bore in a stop member 5, for example of moulded plastics material. Around the end 1*b* of the cord 1, the stop member 5 has a male cylindrical bearing surface 5*a* the diameter of which is chosen to permit its engagement with slight frictional resistance in the bore 4*b* of the tubular coupling 4.

The device illustrated in FIG. 1 is employed in the following manner:

With the tubular coupling 4 and the stop member 5 separated from one another, a row of articles such as $O_1$, $O_2$, $O_3$ (FIG. 2) is threaded onto the cord 1 by sliding their respective perforated portions over the external surfaces 4*c* and 4*d* of the tubular coupling 4. When all the row of articles has been threaded onto the cord 1, in the way just described, the stop member 5 is fastened in the tubular coupling 4 by engaging the male bearing surface 5*a* in the bore 4*b*, where the said bearing surface is retained by friction or slight elastic deformation of the corresponding parts of the members 4 and 5. The row articles, threaded in this way on a sort of flexible ring which is capable of serving as a handle, may then easily be delivered at the same time as a large number of other rows of articles packaged in an identical manner. In order to thread such a row of articles onto the rod 2 of the display unit 3, it suffices to separate the members 4 and 5 by extracting the bearing surface 5*a* from the bore 4*b*; then, with one hand, the operative holds the stop member 5, as shown at the right-hand side of FIG. 2, and, with his other hand, he engages the bore 4*b* of the tubular coupling 4 on the free end 2*b* of the rod 2 of the display unit; finally, by bringing the end 1*a* of the cord 1, which is fastened to the stop member 5, to a height greater than that of the rod 2 of the display unit, or at least higher than its free end 2*b*, the operative causes the row of articles $O_1$, $O_2$, $O_3$ . . . to slide along the cord 1, over the tubular coupling 4 and finally onto the rod 2.

The device for carrying out the method of the invention may be modified in many ways within the scope of the ensuring claims. The external shapes of the members 4 and 5, as well as the way of fastening the two ends of the cord 1 to these members are matters of choice. This is also the case as regards the materials constituting these members and their manner of manufacture; for example, turned metallic members may be suitable. In the case where the rods of display units requiring stocking, or at least the free ends of these rods, all have the same diameter, the internal diameter of the bore **4*b* of the coupling 4 is preferably chosen so as to permit the engagement of the said tubular coupling with slight frictional resistance on the end of a rod of the display unit. However, in cases where the same device must be used for stocking display unit rods having slightly different diameters, it is possible to give the bore 4*b* of the tubular coupling 4 an internal diameter at least equal to the greatest of the diameters of the rods of the display unit, since in practice it is of no inconvenience that the tubular coupling 4 is freely engaged, i.e. without friction, on the ends of certain of the rods of the display unit. It is also possible to provide the tubular coupling 4 with a plurality of internal bores of graded diameters (for example 4*b* and 4*e* in FIG. 1). In the case where it is not envisaged to deliver the articles threaded on a sort of flexible ring, it is not necessary to arrange the stop member 5 in such a way that it can be fastened to the tubular coupling 4** in a removable manner as previously described.

FIG. 3 shows a modified embodiment of the device, in which the stop member 5 includes a releasable catch 6, for example integrally moulded with the stop member, which enables the cord 1 to be coiled in a number of turns of small diameter, so as to avoid tangling of the cords of several devices which are transported or stored together.

In another modified embodiment of the device, the cord 1 is replaced by an elongate, rigid support, in particular a rigid, metallic rod, a first end of which forms, or else is fastened to, a member similar to the tubular coupling 4, previously described, its second end also being capable of being provided with a stop member. In the case of this embodiment with a rigid support, the sliding onto the rod of the display unit of different articles threaded on the support is facilitated, at least in the case of a horizontal rod of a display unit, if the longitudinal axis of the elongate support forms a certain obtuse angle with the longitudinal axis of the rod 2 of the display unit; this angle may exist on the rod 2 of the display unit (at **2*c* in FIG. 2), or it may be provided in the coupling zone between the first end of the elongate support and the tubular coupling 4** to which it is fixed.

What is claimed is:

1. A device for threading perforated articles onto a rod fixed at a first end, the device comprising an elongate support and a tubular coupling fixed to a first end of said support, said tubular coupling being dimensioned internally to receive the second, free end of the rod and being dimensioned externally so that it can pass through the perforations in said articles, in which the elongate support is a flexible cord.

2. A device according to claim 1, in which a stop member is fixed to the second end of the flexible cord.

3. A device according to claim 2, in which the stop member is removably connectable to the tubular coupling so as to form with the cord a flexible ring on which the articles are threaded, so that this flexible ring may serve as a handle for transporting the articles.

4. A device according to claim 2, in which the stop member is provided with a releasable catch.

* * * * *